US008708779B2

(12) United States Patent
Nguyen

(10) Patent No.: US 8,708,779 B2
(45) Date of Patent: Apr. 29, 2014

(54) AIR BLAST BLOWDOWN SILENCER SYSTEM FOR BLAST POT

(76) Inventor: Phuong Taylor Nguyen, Richmond, TX (US)

( * ) Notice: Subject to any disclaimer, the term of this patent is extended or adjusted under 35 U.S.C. 154(b) by 392 days.

(21) Appl. No.: 13/021,256

(22) Filed: Feb. 4, 2011

(65) Prior Publication Data

US 2012/0202407 A1 Aug. 9, 2012

(51) Int. Cl.
*B24C 7/00* (2006.01)

(52) U.S. Cl.
USPC ..... 451/101; 451/99; 451/75; 181/230

(58) Field of Classification Search
USPC ..... 451/101, 99, 75; 181/230, 231; 173/DIG. 2
See application file for complete search history.

(56) References Cited

U.S. PATENT DOCUMENTS

| | | | | | |
|---|---|---|---|---|---|
| 3,687,225 | A * | 8/1972 | Nelson | 181/269 |
| 3,894,610 | A * | 7/1975 | Halter et al. | 181/256 |
| 3,898,063 | A * | 8/1975 | Gazan | 96/384 |
| 3,981,378 | A * | 9/1976 | Potter | 181/230 |
| 3,995,712 | A * | 12/1976 | Leistritz et al. | 181/230 |
| 4,033,428 | A * | 7/1977 | Wennerstrom | 181/230 |
| 4,082,160 | A * | 4/1978 | Schilling et al. | 181/258 |
| 4,109,749 | A * | 8/1978 | Sweet | 181/230 |
| 4,119,174 | A * | 10/1978 | Hoffman | 181/231 |
| 4,424,882 | A * | 1/1984 | Moller | 181/231 |
| 5,556,325 | A * | 9/1996 | Shank, Jr. | 451/101 |
| 5,581,055 | A * | 12/1996 | Self et al. | 181/230 |
| 6,089,348 | A * | 7/2000 | Bokor | 181/272 |
| 6,932,188 | B2 * | 8/2005 | Ni | 181/231 |
| 7,118,468 | B2 * | 10/2006 | Robichaud et al. | 451/456 |
| 2005/0269152 | A1 * | 12/2005 | Sellers et al. | 181/230 |
| 2006/0113145 | A1 * | 6/2006 | Toyoshima et al. | 181/268 |
| 2007/0205044 | A1 * | 9/2007 | Bae et al. | 181/255 |
| 2008/0023265 | A1 * | 1/2008 | Frederiksen et al. | 181/257 |

FOREIGN PATENT DOCUMENTS

| | | | |
|---|---|---|---|
| CA | 2197721 | * | 2/1997 |

* cited by examiner

*Primary Examiner* — George Nguyen

(57) ABSTRACT

The blowdown silencing system includes an initial restrictor in communication with a blast pot vessel for controlling the flow of pressurized air from the vessel into a first expansion chamber. The outlet of the first expansion chamber is in communication with a reducer. The reducer outlet is in communication with a shut-off valve, which may be manually controlled or automatic. The shut-off valve may be upstream or downstream of the reducer. The outlet of the reducer/shut-off valve is introduced into a muffler system which includes an exhaust path and a deflector for absorbing and/or deflecting abrasive particles which may be evacuated from the blast pot vessel during blowdown.

16 Claims, 4 Drawing Sheets

AIR BLAST BLOWDOWN SILENCER SYSTEM FOR BLAST POT

BACKGROUND OF THE INVENTION

1. Field of the Invention

The invention generally relates to apparatus for abrasive blasting and is specifically directed to a silencer system for reducing noise during blowdown operation.

2. Discussion of the Prior Art

Blast pot system are well known in the abrasive blasting industry wherein particulate abrasives are released under pressure against various surfaces in surface preparation applications. It has long been important to depressurize the pressure vessel or blast pot during times of non-use, for periodically replenishing the abrasive material in the vessel or for routine maintenance. The depressurization of blast pots involves first shutting down the system pressure and then releasing the pressure in the vessel through a port commonly referred to as a blowdown port. Typically, this generates a high volume of air and creates with it a loud noise lever, sometimes as high as 127 dB or higher at 100 psig, which is typical during the initial blowdown procedure.

While it is not necessary to reduce this noise level, it is desirable to do so. In addition, particularly when the blast pot is full of particulate abrasive matter during blowdown, the exhausted air contains abrasive particles which can be destructive.

It is, therefore, desirable to reduce the level of noise and contain the destructive flow of particulate matter during blowdown.

Several systems have been designed to provide noise control. One design utilizes a small cylindrical porous element with external wire mesh reinforcement. All of which are encased in a metal housing with two slotted exhaust ports located 180 degrees from each other. The element can be replaced or cleaned by removing a pipe plug at the end. While this design does suppress noise, the porous element can accumulate dust and "clog". In addition, the design is such that the abrasive particles that are entrained in the airstream will rebound off the pipe plug and destructively strike the element. In addition, because of the flow of the destructive particles this design inherently has a short life span in use. In order to prolong life, daily cleaning is require, which is not realistic in the working environment. As a result, end users will usually remove the system once it is damaged. A further drawback to this system is that the slotted port on the side of the housing will direct exhaust air and fugitive particles horizontally. This could blow dust and particles onto anyone near the exhaust.

In another system, the airflow is exhausted through a large porous (small pores) element encased by perforated metal. This design offers decent noise suppression with good airflow. However, the design can trap dust and quickly become more restrictive.

Other examples offer the similar styles that place a porous type element or mesh in the direct or rebound path of the exhaust compressed air near the expansion point.

SUMMARY OF THE INVENTION

The subject invention is directed to an air blast depressurizing system that will provide safer, less destructive, and quieter "blowdown" for depressurizing the blast pot or vessel in abrasive blasting operations. The silencer system of the invention comprises a two stage blowdown system that will allow thru-flow exhaust. The first stage is an expansion chamber sufficiently sized to act as an acoustic filter for octave band above a certain point. This acoustic chamber is created by significantly reducing port upstream and downstream of the acoustic volume. The ratio of the expansion volume diameter to the port diameter is typically in the range of 5:2 or more. The second stage is a through flow silencer or muffler subsystem which is also an expansion chamber and is constructed of specially perforated metal surrounded by porous material which by is an acoustic absorbing material. Both chambers serve to reduce and suppress the untreated exhaust noise. Wear is addressed through the double expansion. First is through the expansion chamber with restrictors upstream and downstream of the volume. These restrictors are sized to reduce the air flow and minimize entrained abrasive particles while causing a minimal increase in blowdown times. Second is through a specially designed muffler. This muffler is sized to expand and slow the compressed airflow. At the exhaust end of the muffler is a removable urethane lined pipe cap to resist the impact wear and minimize the rebound energy of striking particles. Exhaust slots divert the exhaust air horizontally towards the inside of the exhaust shroud which further reduces the particle velocity and diverts the exhaust flow safely downward.

In its broadest sense, the silencer system of the subject invention includes an initial restrictor in communication with a blast pot vessel. The restrictor controls the flow of pressurized air from the vessel into a first expansion chamber. The outlet of the expansion chamber is in communication with a reducer, which typically includes an opening about the same size as the restrictor. Thus air entering and exhausting from expansion chamber is not further pressurized. Typically, the reducer outlet is in communication with a shut-off valve, which may be manually controlled or automatic, as will be described herein. It should also be noted that the shut-off valve may be upstream or downstream of the reducer as a matter of choice. The outlet of the reducer/shut-off valve is introduced into a muffler system, which includes an exhaust path and, where desired, a deflector for absorbing and/or deflecting abrasive particles which may be evacuated from the blast pot during blowdown.

DETAILED DESCRIPTION

Figure 1:
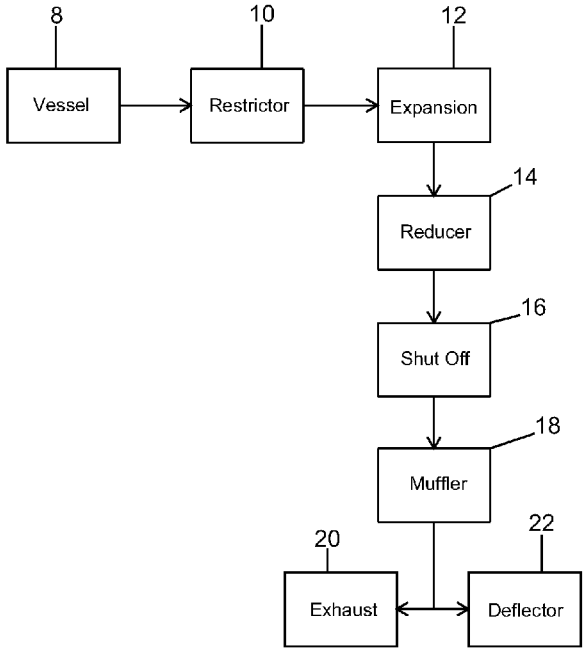
FIG. 1 is a block diagram of the blowdown silencing system of the subject invention.

As diagrammatically illustrated in FIG. 1, the blowdown silencing system of the subject invention comprises an initial restrictor in communication with a blast pot vessel 8. The restrictor 10 controls the flow of pressurized air from the vessel into an expansion chamber 12. The outlet of the expansion chamber 12 is in communication with a reducer 14, which typically includes an opening about the same size as the restrictor. Thus air entering and exhausting from expansion chamber is not further pressurized. In the embodiment shown, the reducer outlet is in communication with a shut-off valve 16, which may be manually controlled or automatic, as will be described herein. It should also be noted that the shut-off valve may be upstream or downstream of the reducer as a matter of choice. The outlet of the reducer/shut-off valve is introduced into a muffler system 18, which includes an exhaust path 20 and, where desired, a deflector 22 for absorbing and/or deflecting abrasive particles which may be evacuated from the blast pot 8 during blowdown.

Figure 2:
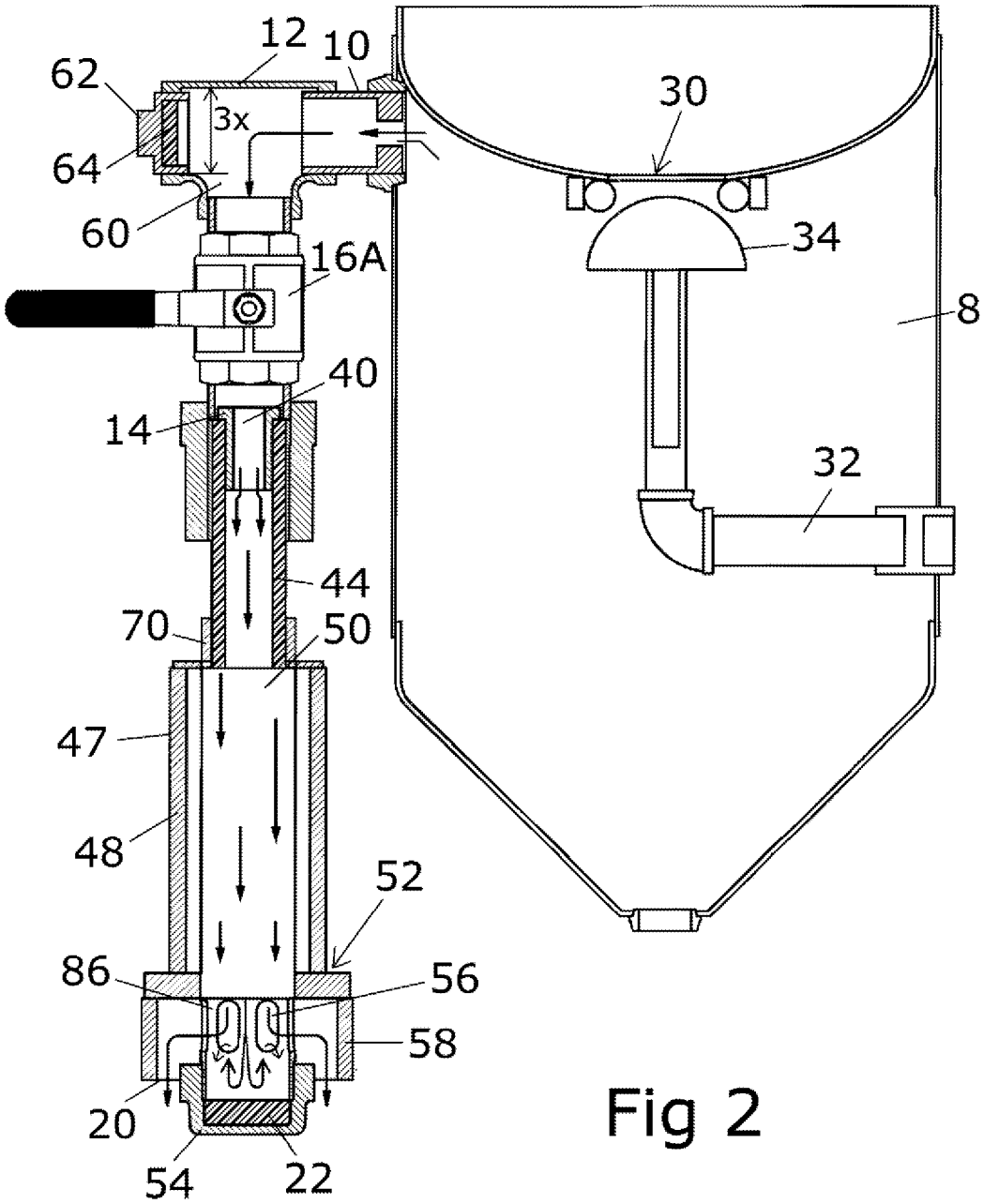
FIG. 2 is a cut-away view of a blast pot with a manual blowdown and flow control system incorporating the blowdown silencing system of the subject invention.

A typical blast pot system is shown FIG. 2. For a more detailed explanation of the operation of the blast pot reference is made to the Abrasive Blaster 2010 manuals publicly available from Axxiom Manufacturing, Inc., 11927 S. Highway 6, Fresno, Tex. 77545, or currently available on line at www.axxiommfg.com. Initially, the fully depressurized abrasive blaster system is filled with abrasive through inlet 30.

In order to assure complete depressurization, the blowdown procedure is followed. Initially, the supply pressure to the blast pot is shut down. This will close the supply pressure in the pop-up valve line 32 and permit the pop-up valve 34 to drop to the open position shown in FIG. 2. In effect, the pressure from the pot keeps the pop-up valve close until the pot is depressurize to the point where gravity will pull the pop-up down.

Prior to opening the blaster, the blowdown procedure is next followed. Specifically, the shutoff valve 16 (FIG. 1) is opened and any pressurized air in the vessel escapes through the open pop-up valve and into the restrictor 10. In the embodiment shown in FIG. 2, the shutoff valve 16 is a manually operated valve 16A and is placed before or upstream of the reducer 14.

The restrictor 10 is in communication with an expansion chamber 12, which is in line with the reducer 14. The expansion chamber provides an initial silencing function. The reducer 14 typically has an inside diameter 40 which is similar to or larger than the inside diameter 38 of the restrictor to maintain pressure equalization as the air passes through the expansion chamber. The flow from the reducer 14 is in line with the muffler assembly 18. The air passes through the muffler body 47 and the exhaust port(s) 20. Where desired, a urethane deflector, or the like, 22 may be inserted into the airflow to capture and/or deflect stray abrasive particles which may be in the air flow.

Figure 3:
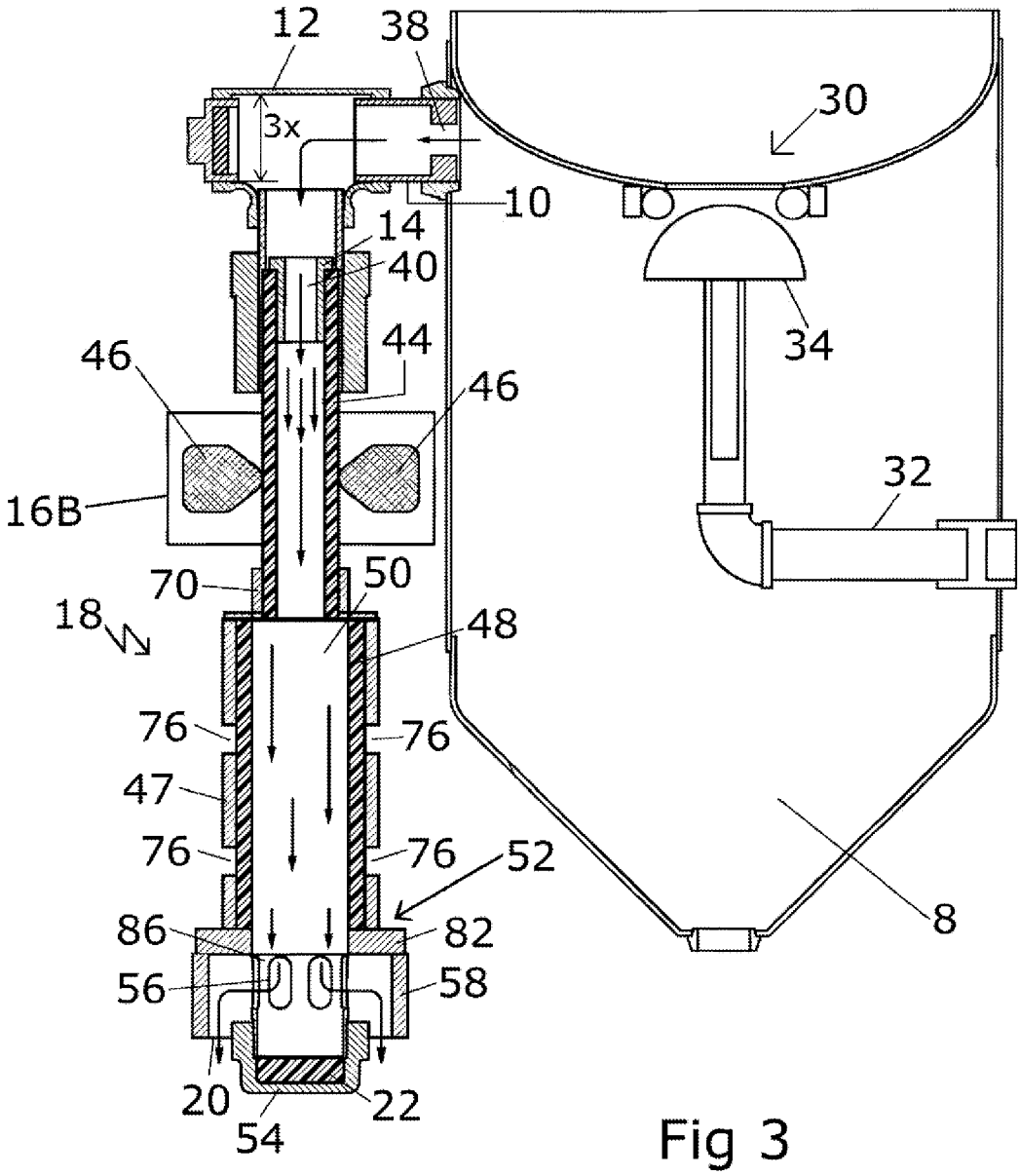
FIG. 3 is a cut-away view of a blast pot with an automated blowdown and flow control system incorporating the blowdown silencing system of the subject invention.

The system of FIG. 3 is identical to that shown in FIG. 2, with the exception that the manual shut-off valve 16A upstream of the reducer 14 has been replaced by an automatic shut-off valve 16B located downstream of the reducer. Valve 16B is a remote control valve that requires a signal to actuate or close the blowdown port and relieving the signal port will open the blowdown. The blowdown port valve is usually normally open. The signal can be from a pneumatic deadman or from an electric solenoid actuated pneumatic control valve. The remote electric signal can come from an electric deadman.

In the example shown in FIG. 3, the conduit 44 between the reducer 14 and the muffler 18 is a flexible tube made of an abrasive resistant rubber. The valve 16B is connected to the system pressure and the rams 46 are designed to close and pinch the conduit 44 to a closed position whenever the operator remotely sends a pneumatic signal to close. This remote pneumatic signal can come from pneumatic control valve that is directly or indirectly controlled by the operator. The rams 46 automatically release when the remote pneumatic signal is removed and the signal port vented to atmosphere, permitting the pinched closed conduit 44 to expand open and permit the blowdown air to pass.

It should be noted that the design of the shut off valve is a matter of choice, for both the manual and the automated version of the system, and well within the purview of those who are skilled in the art.

Figure 4:
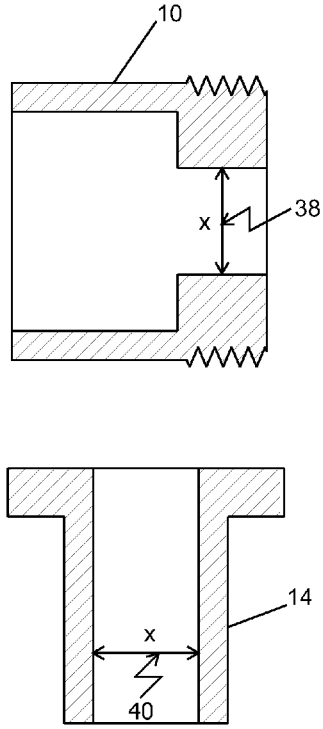
FIG. 4 is a cut-away cross-sectional view of the insert and reducer used in connection with the blowdown silencing system of the subject invention.

The blowdown silencer system to the subject invention is a two stage blowdown system that will allow "thru-flow" exhaust. The first stage is provided by the expansion chamber 12 sufficiently sized to act as an acoustic filter for octave band above a certain point. This acoustic chamber is created by significantly reducing port of the acoustic volume upstream via the restrictor 10 and downstream via the reducer 14. As better shown in FIGS. 3 and 4, the ratio of the volume diameter of the expansion chamber 12 to the port diameter of the restrictor 10 and the reducer 14 is 5:2 minimum, as indicated by the arrows "3X" and "X", respectively. The second stage is a through a muffler or flow silencer subsystem 18 that in the preferred embodiment includes a outer housing 47 and an insert or sleeve 48 constructed of specially perforated metal surrounded by mineral wool for defining an acoustic absorbing material. The expansion chamber 12 and the muffler 18 serve, in combination, to reduce and suppress the untreated exhaust noise from the blast pot during depressurization or blowdown.

Typically, during blowdown some of the abrasive in the blast pot will be exhausted with the escaping air through restrictor 10. The wear caused by this is addressed through the double expansion provided by the expansion chamber 12 and the muffler 18. First is through the expansion chamber with restrictors upstream and downstream of the volume. These restrictors are sized to reduce the air flow and minimize entrained abrasive particles while causing a minimal increase in blowdown times. Second is through the muffler system. The muffler chamber 50 is sized to expand and slow the compressed airflow passing through the reducer. At exhaust end 52 of the muffler is a removable urethane lined insert of deflector 22 in the muffler cap 54 to resist the impact wear and minimize the rebound energy of striking particles. Exhaust slots 56 divert the exhaust air horizontally towards the inside of the exhaust shroud 58 which further reduces the particle velocity and diverts the exhaust flow safely downward through the exhaust ports 20.

As best shown in FIGS. 1-3, in the preferred embodiment the blowdown silencer system comprises the restrictor 10 connected directly to the blowdown exhaust port of the blast pot vessel 8. The restrictor 10 is in communication with the first expansion chamber 12. The expansion chamber 12 has an inside diameter which is a minimum of three times the inside diameter of the restrictor 10, as indicated by the arrow "3X" in FIG. 2 and "X" in FIG. 4 In the illustrated embodiment the exit port 60 of the expansion chamber 12 is at a right angle with the restrictor. This is merely a matter of choice and is incorporated here to maintain a minimum space required for the blast pot and silencer system combination. A cleanout and wear plug 62 is provided at the outer end of the expansion chamber. It is desirable to provide an absorbing insert or liner 64 on the plug to reduce wear. The insert may be replaceable, where desired.

In the embodiment of FIG. 2 the manual shut-off valve 16A is in direct communication with the exit port 60 of the expansion chamber 12. In the embodiment of FIG. 3 the automated shut-off valve 16B is positioned downstream of the reducer 14. The placement of the shut-off valve is a matter of choice. However, by placing the manual shut-off valve directly between the expansion chamber and the reducer, the number of parts of the assembly is kept to a minimum.

The reducer insert 14 is placed inside the flex conduit 44. It will be understood by those who are skilled in the art that the flex conduit 42 may be replaced by a rigid conduit when the manual shut-off mechanism 16A is used, or for other applications where the shut-off does not require pinching the conduit to a closed position.

The flex conduit 44 is connected to the muffler intake end cap 70 for directing the air flow into the interior chamber 50 of the second expansion chamber or muffler subsystem 18. In one embodiment, the outer wall 74 of the muffler 18 is a rigid, closed tube, as shown in FIG. 2. As later described, and as shown in FIG. 3, the outer wall 47 may include ports or through holes 76 to further reduce noise by reducing pressure in the chamber 72. The inner liner or insert sleeve 48 of the muffler is a porous, absorbent material for absorbing both particulate matter and sound, further reducing the sound generated by the air flow. In the preferred embodiment, the sleeve is a perforated metal surrounded by mineral wool for enhancing sound deadening properties.

Figure 5:
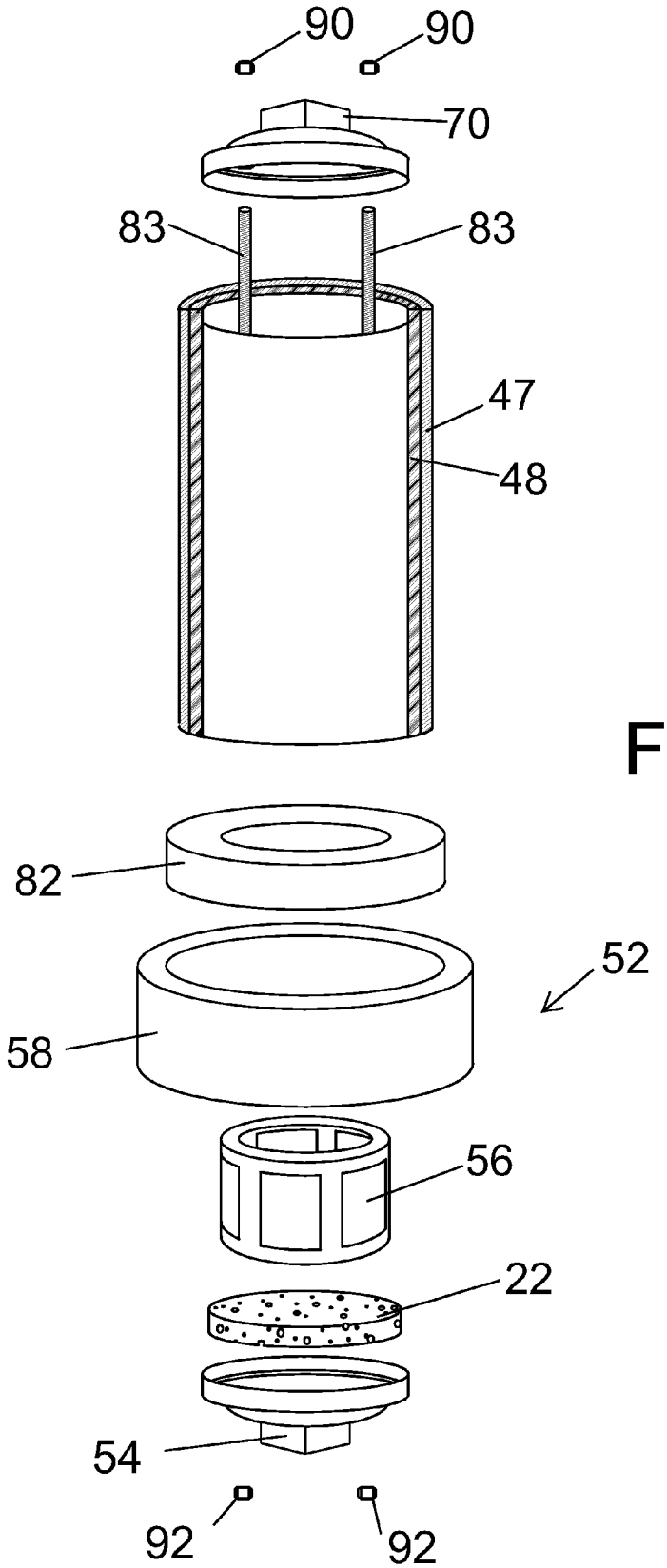
FIG. 5 is an exploded view of the muffler subsystem.

A detailed exploded view of the muffler subassembly 18 is shown in FIG. 5. The outer wall 47 is a rigid tube. The inner sleeve 48 is placed within the tube and is made of a suitable material for absorbing and reducing the sound of the airstream as it flows through the chamber. The inlet side cap 70 is positioned over the upper open end of the sleeve and tube. The base ring 82, shroud 58, tail piece 58, deflector 22 and end cap 54 form the exhaust end 52 of the muffler subassembly. The base ring 52 is secured to the lower end of the tube 47 and sleeve 48. A tail piece 86 is mounted on the ring 82 and is concentric with the tube and sleeve. The shroud, ring and tail piece assembly are secured to the sleeve, tube and inlet side cap assembly by suitable means such as the elongated screws 88 and the nuts 90 and 92. The deflector 22 is positioned in the removable end cap 54 which is then placed on the tail piece 86. The end cap 54 may be removed for maintenance and for replacing the replaceable deflector 22.

The silencer system of the subject invention provides apparatus for reducing the noise level of the blowdown operation as well as capturing and/or redirecting abrasive particles which may be in the airstream. In some cases, the noise level of 127 dB at the blowdown outlet of the vessel has been reduced to 120 dB at the outlet of the first expansion chamber 12 and less than 110 dB at the outlet ports 20 of the muffler subassembly.

While certain features and embodiments of the invention have been described in detail herein, it should be understood that the invention encompasses all modifications and enhancements within the scope and spirit of the following claims.

The invention claimed is:

1. A two stage silencer system for reducing noise during blowdown operation of a blast pot vessel used in abrasive blasting operations, the system comprising:

a. A first expansion chamber in communication with a blowdown outlet port of the vessel;

b. A second expansion chamber in communication with and downstream of the first expansion chamber, the second expansion chamber further including:

i. A sound absorbing material;

ii. An outlet redirecting airflow in a direction different from the direction of airflow in passing through the blowdown outlet port of the vessel;

c. A shut-off valve positioned downstream of the first expansion chamber and upstream of the second expansion chamber; and d. A restrictor upstream of the first expansion chamber for controlling the flow of air from the blowdown outlet port of the vessel, wherein both the restrictor and the first expansion chamber are of a generally cylindrical cross-section and wherein the inner diameter of the first expansion chamber is approximately two and one half times the inner diameter of the restrictor.

2. The two stage silencer system of claim 1, further comprising a reducer downstream of the first expansion chamber.

3. The two stage silencer system of claim 2, wherein the reducer is of a generally cylindrical cross-section and wherein the inner diameter of the expansion chamber is approximately three time the inner diameter of the reducer.

4. The two stage silencer system of claim 1, wherein the shut-off valve is manually operated and is moveable between a fully open position and a fully closed position.

5. The two stage silencer system of claim 1, wherein the shut-off valve is automatically activated to open airflow when the abrasive blasting system is not in operation and activated to close airflow when the abrasive blasting system is in operation.

6. The two stage silencer system of claim 5, wherein the automatic shut-off valve is secured to and surrounds a flexible conduit which is positioned between the first expansion chamber and the second expansion chamber and wherein the automatic shut-off valve is adapted for pinching the flexible conduit to a closed position when the valve is activated to close airflow and is adapted to release the flexible conduit from a pinched condition when the valve is activated to open airflow.

7. The two stage silencer system of claim 1, wherein the second expansion chamber further comprises:

a. An outer rigid tube having open ends, the upstream end of the tube in line with the first expansion chamber;

b. A sleeve within the tube, the sleeve being constructed of a sound absorbing material; and c. An exhaust assembly at the downstream end of the tube.

8. The two stage silencer system of claim 7, the exhaust assembly further comprising:

a. A base ring mounted on the downstream side of tube;

b. An open cylindrical shroud of a diameter larger than the tube and mounted on the ring;

c. A tail piece mounted in concentric relationship with the tube and having an inner diameter of approximately the same diameter as the inner diameter of the sleeve, the tail piece including radial slots for redirecting the airflow in a direction radially outward from the axis of the tube and sleeve and into the interior wall of shroud;

d. A removable end cap on the tail piece for closing the tail piece, wherein the exhaust path is defined by the clearance between the interior wall of the shroud and the outer wall of the end cap.

9. The two stage silencer system of claim 8, further comprising a soft material deflector in the end cap.

10. The two stage silencer system of claim 9, wherein the deflector is replaceable as a maintenance component of the system.

11. The two stage silencer system of claim 1, including a removable clean out cap on the first expansion chamber and in direct line with the airstream from the vessel.

12. The two stage silencer of claim 11, further comprising a soft material deflector in the clean out cap.

13. The two stage silencer of claim 12, wherein the deflector is replaceable as a maintenance component of the system.

14. The two stage silencer of claim 7, wherein the sleeve is replaceable as a maintenance component of the system.

15. The two stage silencer of claim 1, wherein the shut-off valve is positioned downstream of the reducer.

16. The two stage silencer of claim 1, wherein the shut-off valve is positioned upstream of the reducer.

* * * * *